US005799501A

United States Patent [19]

Leonard et al.

[11] Patent Number: 5,799,501

[45] Date of Patent: Sep. 1, 1998

[54] BEVERAGE COOLING DEVICE

[76] Inventors: Richard T. Leonard, 446 Conradi St. B202; Steven B. Tucker, 410 Chapel Dr. Apt #4, both of Tallahassee, Fla. 32304

[21] Appl. No.: 272,048

[22] Filed: Jul. 8, 1994

[51] Int. Cl.[6] ..... F25D 3/08

[52] U.S. Cl. ..... 62/457.3; 62/530

[58] Field of Search ..... 62/457.3, 527, 62/530, 371

[56] References Cited

U.S. PATENT DOCUMENTS

| | | | |
|---|---|---|---|
| 2,075,137 | 3/1937 | Rosen | 62/457.3 |
| 2,187,558 | 1/1940 | Kushima | 62/457.3 |
| 4,034,213 | 7/1977 | Norris | 240/6.46 |
| 4,580,405 | 4/1986 | Cretzmeyer | 62/63 |
| 5,044,173 | 9/1991 | Cheng | 62/372 |
| 5,148,688 | 9/1992 | Pimm et al. | 62/457.3 |
| 5,189,892 | 3/1993 | Roberts | 62/372 |
| 5,299,433 | 4/1994 | Harms et al. | 62/457.2 |

*Primary Examiner*—William Doerrler
*Attorney, Agent, or Firm*—Peter Loffler

[57] ABSTRACT

An improved beverage cooling device is disclosed. The device consists of a main body. The main body is filled with a freezable material. A suction cup is attached to an open beverage container and the main body, after being sufficiently cooled, is threadably attached to the suction cup. A ring is attached to the top of the main body to allow for comfortable handling of the cold main body. An optional second ring is attached to the bottom of the main body for aesthetic appeal.

8 Claims, 2 Drawing Sheets

BEVERAGE COOLING DEVICE

BACKGROUND OF THE INVENTION

1. Field of the Invention.

This invention relates generally to a beverage cooling device and more particularly to an improved beverage cooling device designed to be inserted into an open beverage container such as a pitcher or a mug.

2. Background of the Prior Art.

Drinking a cold beverage on a hot day is one of life's finer pleasures. After a grueling summer day at the beach or fishing, nothing is more rewarding than pulling up a seat in either a shady or air conditioned respite, kicking back your feet, and drinking a cold one. It makes the entire day worthwhile.

In an individual serving, keeping a beverage, such as beer, cold poses very little problem. Keeping a 12 ounce can, bottle, or mug of beverage cold during its short life expectancy is of no moment. The beverage is just a pleasant memory before it has had a chance to warm up.

The problem arises when two or more people order a beverage en mass. Typically, such wholesale orders are delivered in a pitcher. Unlike its junior counterpart, the mug, a pitcher will tend to sit on the table top much longer. As the ambient room temperature is much higher than the idle pitcher, the beverage within will tend to warm up an unwanted result indeed.

What is needed is a means of keeping the beverage within the pitcher cold while it awaits consumption. Many devices, both complex and simple, have been proposed toward this end. The current state of the art is found in one of two broad methods.

One method of keeping pitchers of beverage cold is to float a cup or plastic bag, such a Glad sandwich bag, of ice in the pitcher. The ice will absorb the heat of the beverage. As the ice is confined within a container, the melting ice will not interact with the beverage and will therefore, not dilute the beverage.

Alternatively, a more permanent carrier for the ice, as disclosed in U.S. Pat. No. 4,843,836 issued to Childers, may be utilized. The Childers invention, which is inserted into the pitcher, functions in the same manner as the cup or bag of ice.

The second method of keeping a pitcher of beverage cold is found, for example, U.S. Pat. No. 5,235,823 issued to Coker. In the Coker invention, a sealed device contains within it a freezable material, such as water. The device is placed into a freezer prior to use to permit the freezable material to freeze. Thereafter, the device is removed from the freezer and placed into the pitcher.

The beverage will interact with the device wherein the freezable material will absorb the heat of the beverage, thereby keeping the beverage cold. As the freezable is wholly contained within the device, beverage dilution will not occur.

Both of the above methods perform an adequate job in keeping beverages cold. Furthermore, they are relatively straightforward, simple, and inexpensive in relation to the more exotic techniques.

However, the above beverage chilling techniques suffer from a major drawback—aesthetics. The devices are unsightly and therefore detract from the experience of an otherwise tasty beverage.

Floating a cup of plastic bag of ice in the pitcher looks untidy. The introduced bag vessel appears as a foreign object. It gives the appearance that the restaurant's kitchen inadvertently dropped something into a patron's pitcher and chose not to fish it out.

Devices such as those disclosed by Childers and Coker are equally undesirable. They too appear as foreign objects within the beverage. They give the appearance that someone left a large strange stirring spoon within the pitcher.

Furthermore, as the devices are not anchored, they tend to move around. The devices must be held when the pitcher is being poured for fear of the device falling out of the pitcher and making a mess.

What is needed is a beverage cooling device, of relatively simple construction, that does not appear out of place within an open container such as a pitcher. The device should have a neutral effect on appearance, or, more preferably, the device should improve the appearance. Ideally, the device should occupy a fixed position within a pitcher.

SUMMARY OF THE INVENTION

The device of the present invention overcomes the above-mentioned shortcomings. The device provides for a beverage cooling device to be used with open beverage containers, in which the device does not appear out of place or as a foreign object.

The device has a hollow body that is attached to the bottom of a pitcher or other open beverage container by the use of a suction cup. A gripping ring is used to assist in attaching the body to the suction cup. The device is symmetrical and wholly contained within the beverage vessel and therefore appears as a natural addition or extension of the pitcher or other container.

The hollow body is filled with water or other freezable material. A beverage that contacts the body will transfer heat to the body which heat will be absorbed by the freezable material within. The hollow body is completely sealed. The body is thin-walled and is fabricated from a material having high heat transfer capabilities for maximum efficiency in removing heat from the beverage.

By using a suction cup to affix the device to the pitcher, the invention will remain stationary while in use. It will not tend to fall out when pouring a beverage from the pitcher.

Several methods can be employed to increase the aesthetic appearance of the device. The device can be cylindrical shaped and be decorated to appear like a can of beer or soda. Other designs and shapes can be affixed to the body for both aesthetic appeal and for use as an advertising medium.

The device can be entirely clear so that it is non-conspicuous. The clear device can employ colored freezable material in one or more colors for added effect.

The device is relatively simple, straightforward, and inexpensive to construct and use.

Therefore, it is an object of the present invention to provide a beverage cooling device that is used within a pitcher or other similar open topped container, wherein the beverage cooling device is aesthetically appealing.

It is another object of the present invention to provide a beverage cooling device that can be used as an advertising display medium.

It is another object of the present invention to provide a beverage cooling device that will efficiently remove heat from a beverage when the beverage is in fluid communication with the device.

It is another object of the present invention to provide a beverage cooling device that will remain stationary within the beverage vessel.

It is a final object of the present invention to provide a beverage cooling device that is of relatively simple construction.

BRIEF DESCRIPTION OF THE DRAWINGS

Similar reference numerals refer to similar parts throughout the several views of the drawings.

DETAILED DESCRIPTION OF THE PREFERRED EMBODIMENT

Figure 1:
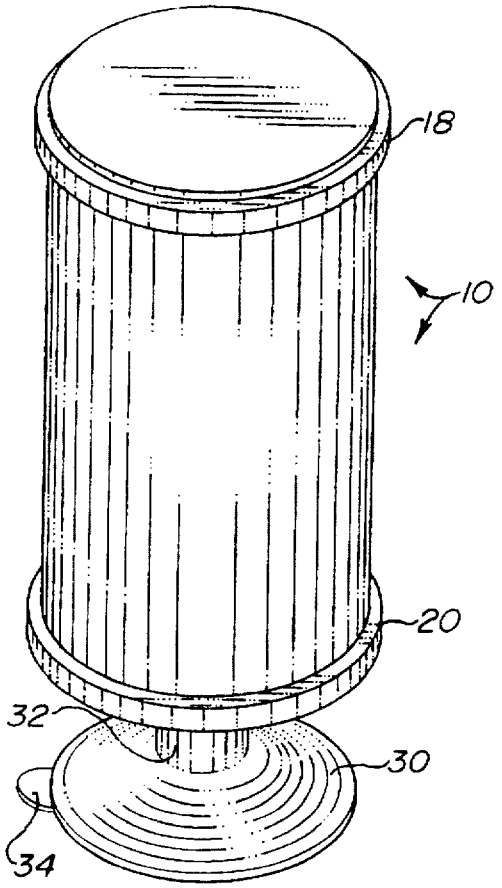
FIG. 1 is a side elevation view of the preferred embodiment of the present invention.
Figure 2:
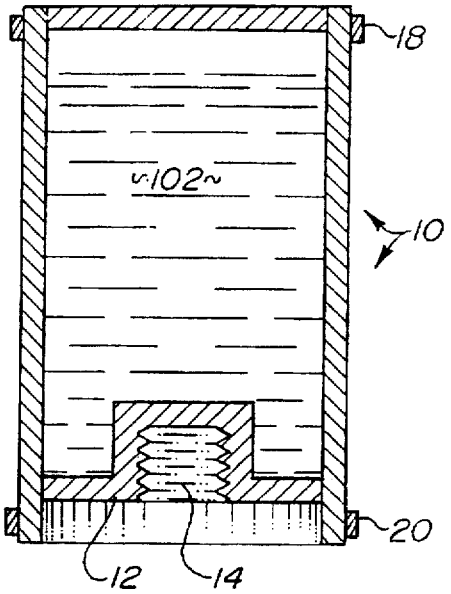
FIG. 2 is a cross-sectional view of the main body of the present invention.
Figure 3:
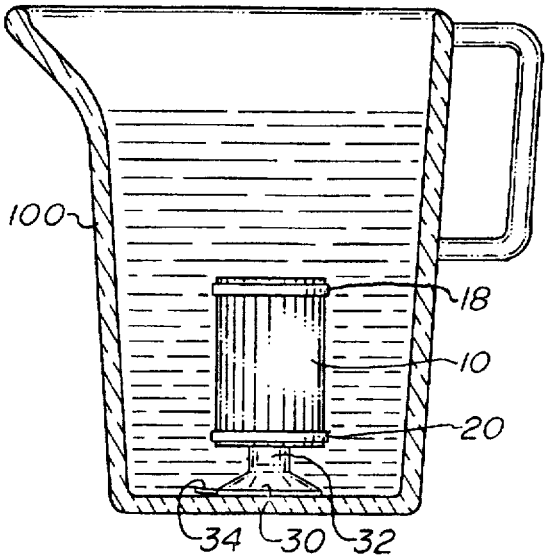
FIG. 3 is a side elevation view of the invention secured within an open beverage container.
Figure 5:
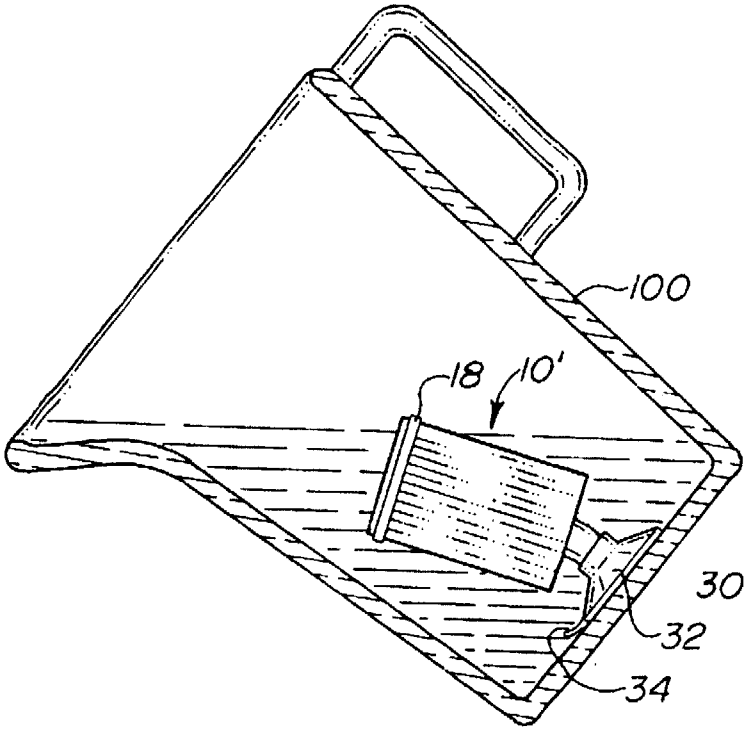
FIG. 5 is a side elevation of the alternate embodiment of the present invention secured within an open beverage container with beverage being poured from the open beverage container.

The device 1 consists of a main body 10. This main body 10 is cylindrical in shape with a hollow interior. Disposed within the interior space of the main body 10 is a freezable material 102. This freezable material 102 will phase change to solid form when the main body 10 is placed inside an ordinary freezer. This phase change will occur relatively quickly. Water or Blue Ice will prove satisfactory as a freezable material. Other freezable materials can also be used.

Although the device 1 is cylindrical in its preferred embodiment, other geometric shapes will work equally well, without loss of functionality or intent.

The main body 10 is permanently and completely sealed so that the freezable material 102 will not escape when the freezable material 102 is in its liquid phase. Therefore, an air gap will be maintained within the interior space of the main body 10. This air gap will allow for orderly freezable material volume expansion during phase changes. This will assure that the main body 10 is not ruptured from within.

The main body 10 is constructed from a material that has high heat transfer capabilities. Therefore, a non-insulating material is preferred. Aluminum and other metals prove very satisfactory for this purpose. However, other materials, such as plastic, will also work. Construction of the main body 10 is relatively thin walled to increase the high heat transfer capability.

Located on the bottom end 12 of main body 10, is an aperture 14. This aperture 14 is threaded. The threading represents female threading.

Located on the top end 16 of main body 10, is a ring 18. This ring 18 encircles the main body 10. The ring 18 is made of plastic or other similar insulating material. The ring 18 is used to grip the main body 10 when the main body 10 is removed from the freezer. This is necessary because the aluminum of the main body 10 will be cold and painful to the touch. If the main body 10 is constructed from an insulating material, the ring 18 is not required.

A suction cup 30 is affixed to the bottom of an ordinary open beverage container such as a pitcher 100. The suction cup 30 has a top end 32. This top end 32 is threaded. This represents a male threading. Attached to the outer circumference of the suction cup 30, is a tab 34.

In order to utilize the present invention, the main body 10 is placed into an ordinary freezer wherein the freezable material 102 within the main body 10 is allowed to freeze. The suction cup 30 is securely attached to the bottom of the open beverage container 100.

After becoming sufficiently cold, the main body 10 is removed from the freezer. The main body 10 is grasped by the ring 18.

The aperture 14 of the main body 10, is mated with the top end 32 of the suction cup 30. The main body 10 is screwed onto the top end 32 of the suction cup 30 providing a secure fit within the open beverage container 100. The ring 18 is used for assistance in screwing the main body 10 onto the top end 32 of the suction cup 30.

Thereafter, beer or other beverage is introduced into the open beverage container 100. The beverage will be in fluid communication with the device 1. The freezable material 102 within the main body 10, absorbs the heat from the beverage thereby keeping it cold for an extended period of time.

If it becomes necessary to use a second main body 10 (because the first main body has sufficiently warmed to become less effective), the first main body 10 is simply unscrewed from the top end 32 of the suction cup 30, and a second main body is screwed in its place.

In order to remove the suction cup 32 from the bottom of the open beverage container 100, a person pulls on the tab 34. The suction of the suction cup 30 will release permitting easy removal.

As the device 1 of the present invention is contained wholly within an open beverage container 100 full of beverage, the device 1, does not appear as a foreign object. The symmetrical shape of the device 1, further adds to the aesthetic appearance within the container 100.

The suction cup 30 will maintain the main body 10 stationary. Therefore, there will be no fear of the device 1 falling out when beverage is poured from the container 100.

Many techniques can be utilized to increase the aesthetic appeal of the device 1. The main body 10 can have a second ring 20 encircling the bottom. This second ring 20, in conjunction with the first ring 18, will give the main body 10 the appearance of a can, such as a can of beer or soda.

The main body 10 can then be decorated to resemble an actual can of beer or soda. The can of beer or soda can be decorated so that the finished can has the same markings as an actual can would have of the brand of beverage actually within the open beverage container 100. Not only will this add aesthetic appeal, it will aid the beverage maker's advertising efforts.

Appealing designs other than those of beverage manufacturers can also be affixed to the main body.

The main body 10 and the suction cup 30 can be fabricated from a clear plastic. As such, their introduction into a open beverage container 100 would be minimal as they would be difficult to detect.

Alternatively, a colored freezable material can be used within the clear plastic main body 10. The color of the freezable material 102 would be chosen so as to maximize aesthetic appeal. If water is the freezable material 102, simple food color can be used to obtain the desired color.

The clear plastic main body can be subdivided into two or more compartments (not illustrated). As such, several colors of freezable material 102, one in each compartment, can be used for a unique display within the open beverage container 100.

Figure 4:
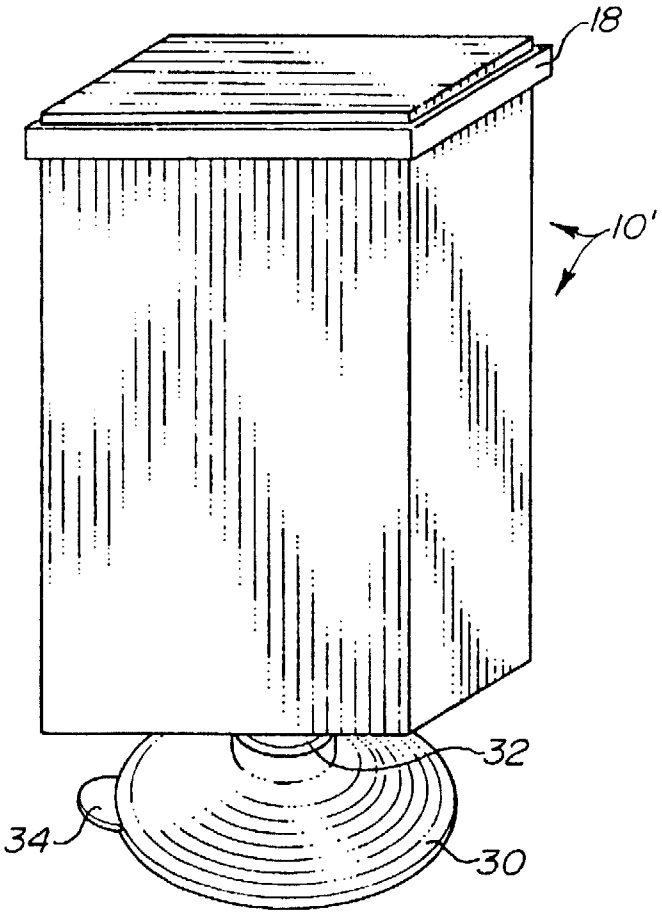
FIG. 4 is perspective view of an alternate embodiment of the present invention.

In an alternative embodiment, the main body 10' will be in the shape of a rectangular solid, as seen in FIG. 4. The main body 10' can utilize all of the above-mentioned aesthetic enhancement techniques. Furthermore, the top end 32 of the suction cup 30 is pivotally attached to the suction cup 30 by pivot means (not illustrated) to permit the top end to sway back and forth.

In this embodiment, the rectangular main body 10' is affixed to the suction cup 32 so that one of the main body's flat surfaces lies parallel to the spout of the pitcher. In such an arrangement, when beverage is being poured from the open beverage container, the hinge means of the suction cup 32 permit the main body 10' to pivot and sit on top of the flowing liquid surface. This assures that the large rectangular surface of the main body 10' is in direct contact with the fluid surface of the exiting liquid. This permits the exiting beverage to deposit its heat onto the main body 10' as its being deposited into the drinker's glass.

It is anticipated that all components for the various embodiments of the present invention will be dishwasher safe for easy cleaning.

While the invention has been particularly shown and described with reference to embodiments thereof, it will be understood by those skilled in the art that various changes in form and detail may be made without departing from the spirit and scope of the invention.

We claim:

1. A beverage cooling apparatus comprising;

a body having a hollow interior and being completely and permanently sealed;

a freezable material disposed within the hollow interior and being completely sealed within the body;

a suction cup threadably attached to the body; and a first ring, constructed of insulating material, encompassing the top of the body.

2. The device as in claim 1 to further include a first ring, constructed of insulating material, encompassing the top of the body.

3. The device as in claim 1 to further include a second ring encompassing the bottom of the body.

4. The device as in claim 1 to further include pivot means, located on the stem of the suction cup, to permit back and forth pivoting of the body relative to the suction cup.

5. A beverage cooling apparatus comprising;

a body having a hollow interior and being completely and permanently sealed;

a freezable material disposed within the hollow interior and being completely sealed within the body;

a suction cup threadably attached to the body; and pivot means, located on the stem of the suction cup, to permit back and forth pivoting of the body relative to the suction cup.

6. The device as in claim 5 wherein the body is thin-walled and non-insulated.

7. The device as in claim 5 to further include a first ring, constructed of insulating material, encompassing the top of the body.

8. The device as in claim 5 to further include a first ring encompassing the bottom of the body.

* * * * *